US009511961B2

(12) United States Patent
Murashima et al.

(10) Patent No.: US 9,511,961 B2
(45) Date of Patent: Dec. 6, 2016

(54) CASSETTE, FEEDER, AND IMAGE FORMING APPARATUS

(71) Applicant: KYOCERA Document Solutions Inc., Osaka (JP)

(72) Inventors: Masaki Murashima, Osaka (JP); Tomoya Hotani, Osaka (JP)

(73) Assignee: KYOCERA Document Solutions Inc., Osaka (JP)

( * ) Notice: Subject to any disclaimer, the term of this patent is extended or adjusted under 35 U.S.C. 154(b) by 0 days.

(21) Appl. No.: 14/889,077

(22) PCT Filed: Jan. 13, 2015

(86) PCT No.: PCT/JP2015/050673

§ 371 (c)(1),
(2) Date: Nov. 4, 2015

(87) PCT Pub. No.: WO2015/115169

PCT Pub. Date: Aug. 6, 2015

(65) Prior Publication Data

US 2016/0083205 A1 Mar. 24, 2016

(30) Foreign Application Priority Data

Jan. 31, 2014 (JP) ..... 2014-017115

(51) Int. Cl.
*B65H 1/04* (2006.01)
*B65H 1/26* (2006.01)

(52) U.S. Cl.
CPC ..... *B65H 1/266* (2013.01); *B65H 1/04* (2013.01); *B65H 2405/1116* (2013.01); *B65H 2405/121* (2013.01)

(58) Field of Classification Search
CPC .. B65H 1/266; B65H 1/04; B65H 2405/11164
See application file for complete search history.

(56) References Cited

U.S. PATENT DOCUMENTS 5,537,195 A 7/1996 Sagara et al.
7,668,502 B2 * 2/2010 Park ..... B65H 1/26 271/147
7,922,171 B2 * 4/2011 Kawamura ..... B65H 1/26 271/145

FOREIGN PATENT DOCUMENTS

JP 06048590 A * 2/1994
JP H08-301461 A 11/1996
(Continued)

OTHER PUBLICATIONS

International Search Report, PCT/JP2015/050673, Apr. 7, 2015.

*Primary Examiner* — Luis A Gonzalez
(74) *Attorney, Agent, or Firm* — Studebaker & Brackett PC

(57) ABSTRACT

A cassette (1) includes first and second sheet accommodation sections (3) and (5), and a restricting section (7). The second sheet accommodation section (5) is slidably attached to the first sheet accommodation section (3). The restricting section (7) includes first and second engagement sections (38*a*) and (78*a*), and a manipulation section (70). The first engagement section (38*a*) is disposed in the first sheet accommodation section (3). The manipulation section (70) is disposed in the second sheet accommodation section (5). The second engagement section (78*a*) engages with the first engagement section (38*a*). A lever portion (71) of the manipulation section (70) is shiftable from a lying down posture to a tilted posture. The second engagement section (78*a*) is disposed in the lever portion (71). Shift of the lever portion (71) from the lying down posture to the tilted posture releases engagement between the first engagement section (38*a*) and the second engagement section (78*a*), and allows the lever portion (71) to be pulled in a first direction (A1) to slide the second sheet accommodation section (5) and extend a size of the cassette (1).

20 Claims, 10 Drawing Sheets

(56) References Cited

FOREIGN PATENT DOCUMENTS

| | | | |
|---|---|---|---|
| JP | H11-011697 | A | 1/1999 |
| JP | 2001-097561 | A | 4/2001 |

* cited by examiner

CASSETTE, FEEDER, AND IMAGE FORMING APPARATUS

TECHNICAL FIELD

The present invention relates to a cassette in which a plurality of sheets are loaded, a feeder, and an image forming apparatus.

BACKGROUND ART

A sheet feed cassette disclosed in Patent Literature 1 includes a cassette main body and a cassette extendable section. The size of the sheet feed cassette is adjusted by sliding in and out the cassette extendable section according to the size of sheets.

The sheet feed cassette has a lock mechanism. The lock mechanism includes an engagement hole and a lock button. The engagement hole is provided in the cassette main body. The lock button is provided in the cassette extendable section.

The lock button is in engagement with the engagement hole in a locked state. Pushing down the lock button releases the lock button from the engagement hole. Thus, the locked state of the cassette main body and the cassette extendable section is released. As a result, the cassette extendable portion becomes slidable relative to the cassette main body.

CITATION LIST

Patent Literature

[Patent Literature 1]

Japanese Patent Application Laid-Open Publication No. 2001-97561

SUMMARY OF INVENTION

Technical Problem

However, the sheet feed cassette disclosed in Patent Literature 1 has the following problem. That is, since manipulating the lock button itself does not slide the cassette extendable section, a user is required to grab a certain part of the cassette extendable section and slide in or out the cassette extendable portion. Accordingly, manipulation of at least two parts is needed in order to release the locked state and slide in or out the cassette extendable portion.

In view of the above-described problem, the present invention has been made to provide a cassette whose size is adjustable by simple manipulation, a feeder, and an image forming apparatus.

Solution to Problem

According to a first aspect of the present invention, a cassette receives loading of a plurality of sheets and is extendable in a first direction. The cassette includes a first sheet accommodation section, a second sheet accommodation section, and a restricting section. The second sheet accommodation section is slidably attached to the first sheet accommodation section. The restricting section restricts sliding of the second sheet accommodation section. The restricting section includes at least one first engagement section, a manipulation section, and a second engagement section. The first engagement section is disposed in the first sheet accommodation section. The manipulation section is disposed in the second sheet accommodation section. The second engagement section is disposed in the manipulation section and engages with the first engagement section. The manipulation section has a base end portion connected with the second sheet accommodation section and a lever portion continuous from the base end portion. The lever portion is shiftable from a lying down posture to a tilted posture when so manipulated. The second engagement section is disposed in the lever portion. Shift of the lever portion from the lying down posture to the tilted posture releases engagement between the first engagement section and the second engagement section, and allows the lever portion to be pulled in the first direction to slide the second accommodation section and extend a size of the cassette.

According to a second aspect of the present invention, a feeder includes the cassette according to the first aspect and a feeding section. The feeding section feeds a sheet from the sheets in the cassette.

According to a third aspect of the present invention, an image forming apparatus includes the feeder according to the second aspect and an image forming section. The image forming section forms an image on the sheet fed by the feeder.

Advantageous Effects Of Invention

According to the present invention, a user shifts the lever portion to the tilted posture to release the engagement, and subsequently pulls the lever portion in the first direction or pushes the lever portion in a second direction opposite to the first direction to slide the second sheet accommodation section. That is, the releasing of the engagement and the sliding can be performed by a series of manipulation actions on the lever portion. Consequently, the size of the cassette can be adjusted by simple manipulation.

DESCRIPTION OF EMBODIMENTS

Figure 1:
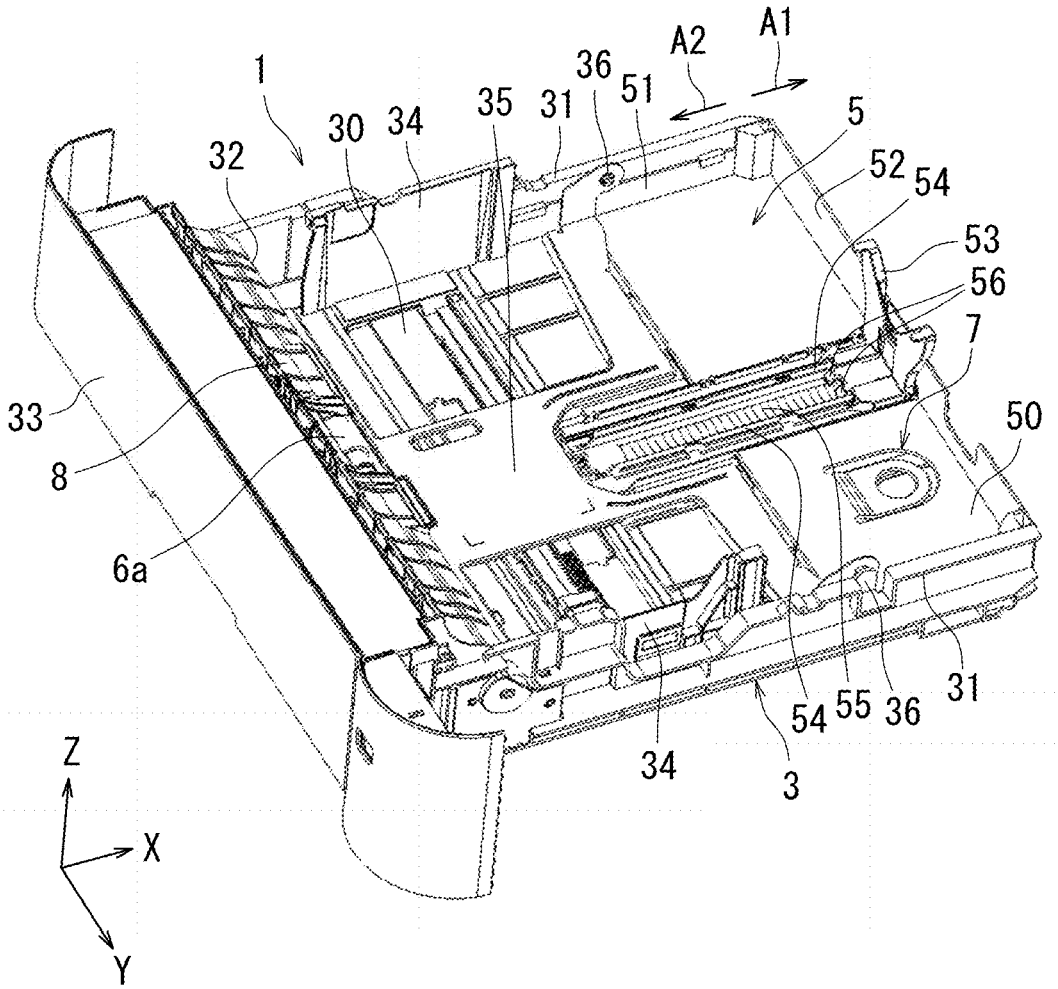
FIG. 1 is a perspective view of a cassette according to a first embodiment of the present invention.

Hereinafter, embodiments of the present invention will be described with reference to the drawings. It should be noted that elements in the drawings that are the same or equivalent are labelled using the same reference signs and description thereof is not repeated.

(First Embodiment)

[Basic Principle]

The basic principle of a cassette 1 according to the first embodiment of the present invention will be described with reference to FIGS. 1 to 4. FIG. 1 is a perspective view of the cassette 1. A plurality of sheets (not shown) are loaded in the cassette 1. The size of the cassette 1 is adjustable. Specifically, the cassette 1 is extendable in a first direction A1 (hereinafter, referred to as "extending direction A1"). The cassette 1 includes a main cassette 3 (first sheet accommodation section), a sliding cassette 5 (second sheet accommodation section), and a restricting section 7. The sliding cassette 5 is slidably attached to the main cassette 3. The restricting section 7 restricts sliding of the sliding cassette 5.

Figure 2:
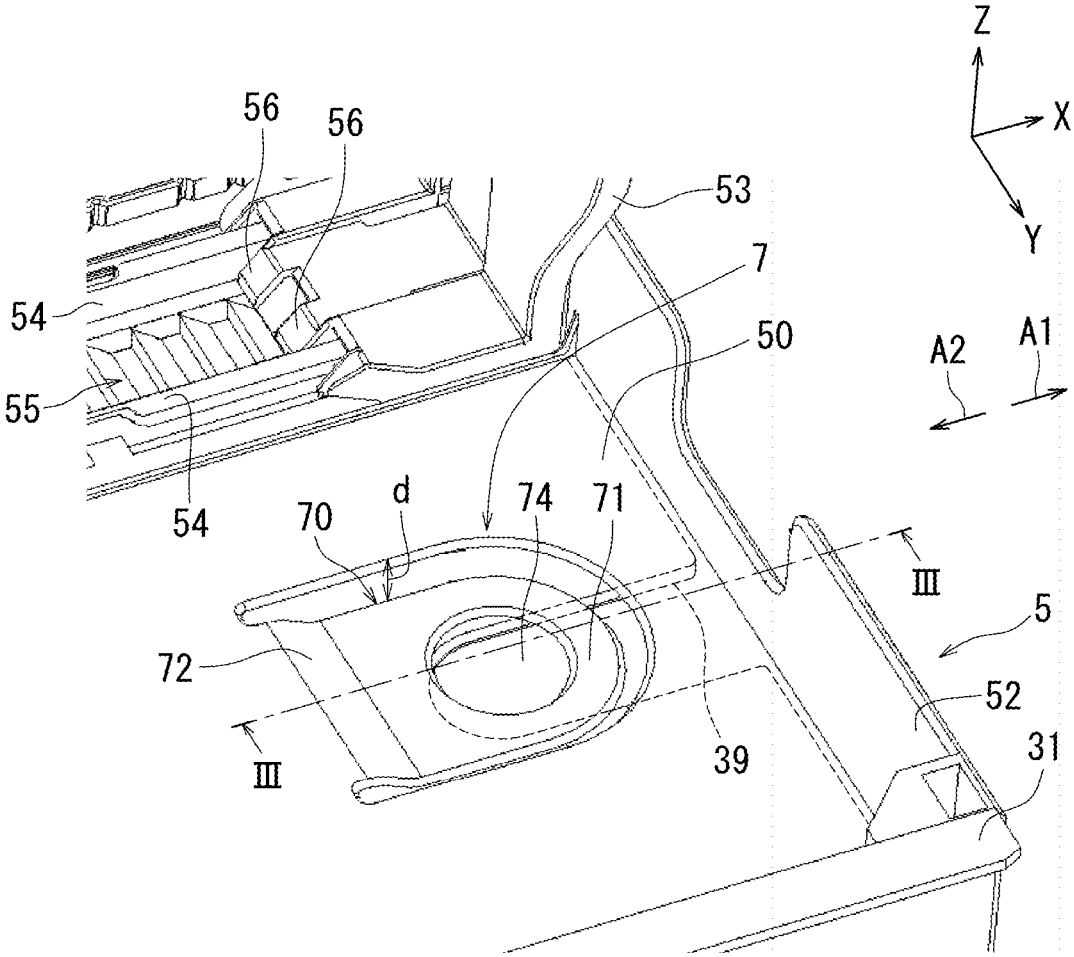
FIG. 2 is an enlarged perspective view of a restricting section of the cassette according to the first embodiment of the present invention.
Figure 3:
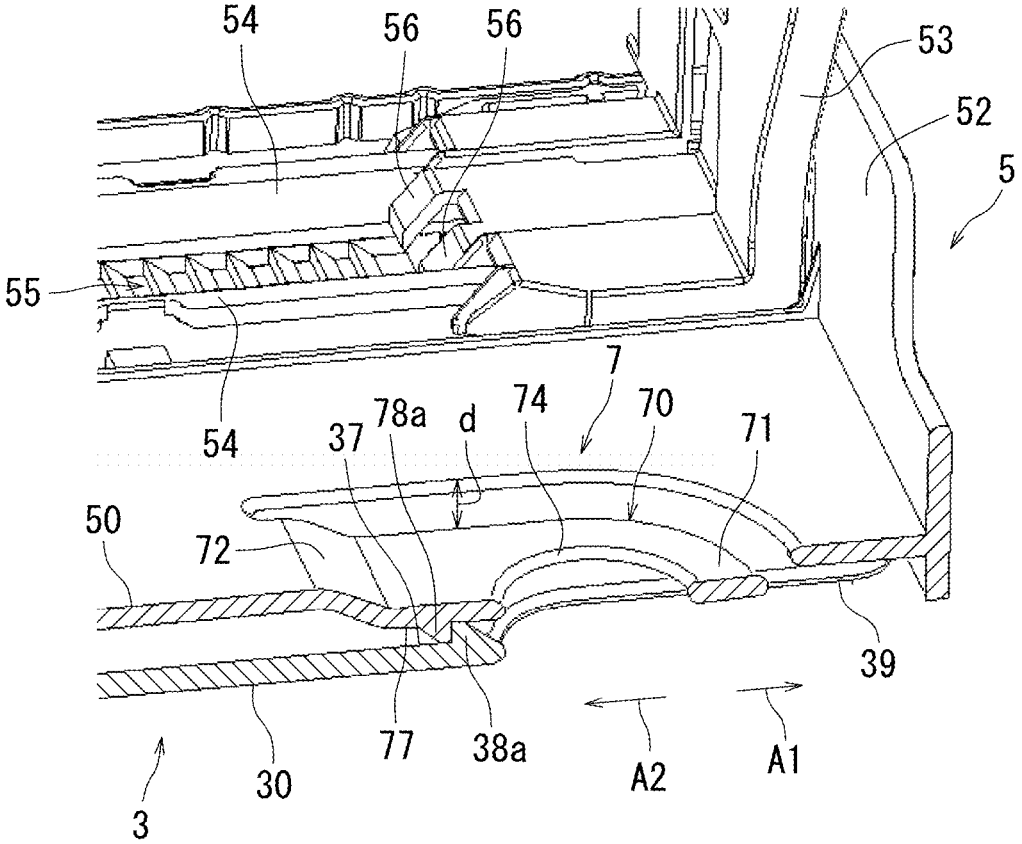
FIG. 3 is a perspective cross-sectional view illustrating the restricting section of the cassette according to the first embodiment of the present invention (engaged state).
Figure 4:
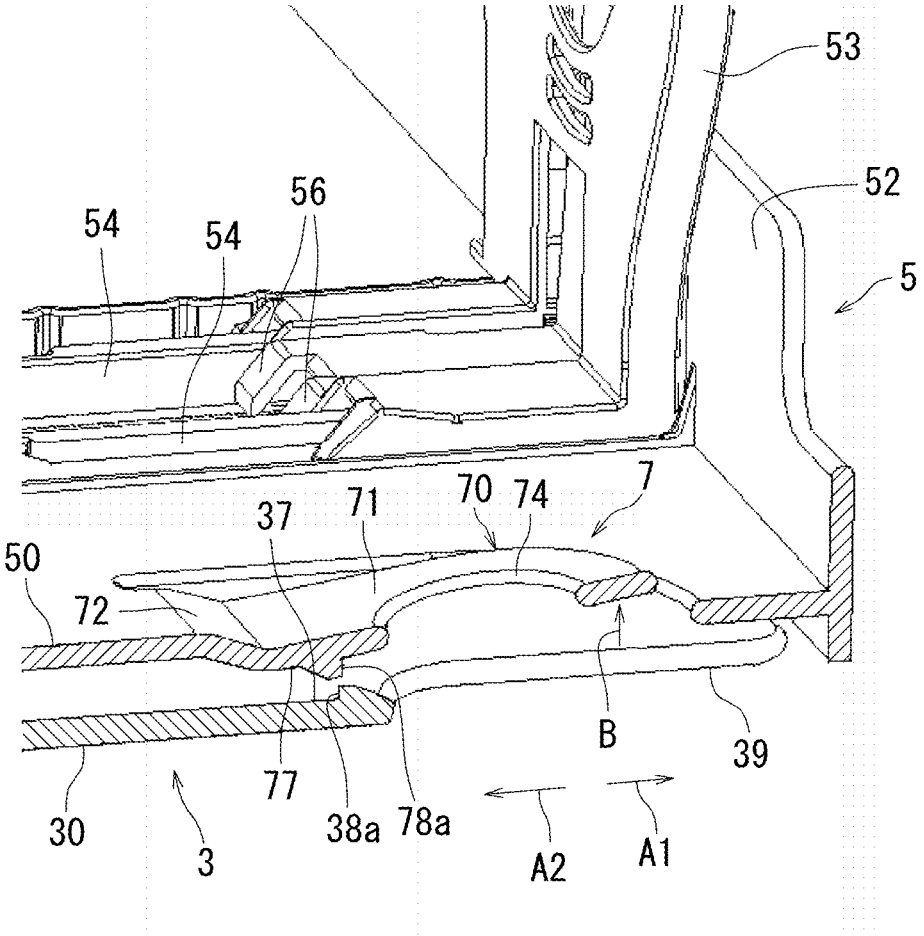
FIG. 4 is a perspective cross-sectional view illustrating the restricting section of the cassette according to the first embodiment of the present invention (disengaged state).

FIG. 2 is an enlarged perspective view of the restricting section 7 of the cassette 1. FIG. 3 is a perspective cross-sectional view illustrating an engaged state of the restricting section 7, taken along line III-III in FIG. 2. FIG. 4 is a perspective cross-sectional view illustrating a disengaged state of the restricting section 7. The restricting section 7 includes a first protrusion 38*a* (first engagement section), a manipulation section 70, and a second protrusion 78*a* (second engagement section). The first protrusion 38*a* is disposed in the main cassette 3. The manipulation section 70 is disposed in the sliding cassette 5. The second protrusion 78*a* is disposed in the manipulation section 70 and engages with the first protrusion 38*a*.

The manipulation section 70 has a base end portion 72 connected with the sliding cassette 5 and a lever portion 71 formed continuous from the base end portion 72. The lever portion 71 is shiftable from a lying down posture (see FIG. 3) to a tilted posture (see FIG. 4) when so manipulated. The second protrusion 78*a* is disposed in the lever portion 71. The shift in posture of the lever portion 71 from the lying down posture to the tilted posture releases the engagement between the first protrusion 38*a* and the second protrusion 78*a*, and allows the lever portion 71 to be pulled in the extending direction A1 to slide the sliding cassette 5 and extend the size of the cassette 1. The extending direction A1 is a direction in which the lever portion 71 is pulled, that is, a direction in which the main cassette 3 is drawn.

According to the first embodiment, a user can slide the sliding cassette 5 by shifting the lever portion 71 to the tilted posture to release the engagement, and subsequently pulling the lever portion 71 in the extending direction A1 or pushing the lever portion 71 in a second direction A2 (hereinafter, referred to as a "contracting direction A2") that is opposite to the extending direction A1. That is, the releasing of the engagement and the sliding can be performed by a series of manipulation actions on the lever portion 71. Consequently, the size of the cassette 1 can be adjusted by simple manipulation. It should be noted that the contracting direction A2 is a direction in which the lever portion 71 is pushed, that is, a direction in which the main cassette 3 is pushed in.

[General Configuration of Cassette 1]

General configuration of the cassette 1 will be described with reference to FIG. 1. In the first embodiment, an X axis and a Y axis are horizontal axes perpendicular to one another, and a Z axis is a vertical axis. The extending direction A1 and the contracting direction A2 are substantially parallel to the X axis. A sheet conveyance direction in the cassette 1 is substantially the same as the contracting direction A2, and a direction opposite to the sheet conveyance direction is substantially the same as the extending direction A1. In embodiments of the present invention, a forward end or a forward end portion of each member or section is a forward end or a forward end portion of the member or section in the contracting direction A2, that is, a forward end or a forward end portion of each member or section in the sheet conveyance direction. A rearward end or a rearward end portion of each member or section is a rearward end or a rearward end portion of the member or section in the contracting direction A2, that is, a rearward end or a rearward end portion of each member or section in the sheet conveyance direction. A positive direction of the Z axis is an upward direction B, and a negative direction of the Z axis is a downward direction. FIG. 1 illustrates the cassette 1 in a minimum size state with the sliding cassette 5 pushed in the contracting direction A2 to the maximum.

The sliding cassette 5 is slidable in the extending direction A1 relative to the main cassette 3. Sliding the sliding cassette 5 in the extending direction A1 therefore extends the size of the cassette 1, allowing larger-sized sheets to be loaded in the cassette 1. The sliding cassette 5 is slidable also in the contracting direction A2 relative to the main cassette 3. Sliding the sliding cassette 5 in the contracting direction A2 therefore contracts the size of the cassette 1, allowing smaller-sized sheets to be loaded in the cassette 1. In the first embodiment, the cassette 1 can be adjusted to a normal size with the sliding cassette 5 pushed in to the maximum and to an extended size with the sliding cassette 5 drawn out to the maximum. The extended size defines a maximum size of sheets that can be loaded in the cassette 1.

The main cassette 3 is formed mainly from a synthetic resin. The main cassette 3 includes a plate-like bottom section 30, a pair of side end sections 31, a forward end section 32, a panel 33, a lift plate 35, a pair of shafts 36, and a pair of side end guides 34. The main cassette 3 is open at a rearward end thereof. The forward end section 32 is stood from the bottom section 30 and elongated along the Y axis. A sheet conveyance guide 8 and a retard roller 6*a* are disposed in the forward end section 32. The panel 33 is disposed on a front surface of the forward end section 32. The pair of side end sections 31 are opposite to one another, stood from the bottom section 30, and elongated along the X axis.

The pair of shafts 36 are disposed corresponding to the pair of side end sections 31. The lift plate 35 is disposed on an upper surface of the bottom section 30. Each end of a base end portion of the lift plate 35 has a supporting hole (not shown) through which the corresponding one of the shafts 36 penetrates. Each end of the base end portion of the lift plate 35 is rotatably supported by the shaft 36. Thus, a forward end portion of the lift plate 35 can be lifted up and down, rotating about the shafts 36.

The pair of side end guides 34 are disposed opposite to one another and corresponding to the pair of side end sections 31. Each side end guide 34 is stood along the corresponding one of the side end sections 31. The pair of side end guides 34 are connected with a rack-and-pinion mechanism (not shown). Accordingly, the pair of side end guides 34 are geared to one another and movable in directions for approaching one another or in directions for separating from one another along the Y axis.

The sliding cassette 5 is formed mainly from a synthetic resin. The sliding cassette 5 includes the restricting section 7, a plate-like bottom section 50, a pair of side end sections 51, a rearward end section 52, a rearward end guide 53, a pair of rails 54, and a plurality of ratchet teeth 55. The restricting section 7 is disposed in the bottom section 50. The sliding cassette 5 is open at a forward end thereof. The pair of side end sections 31 are opposite to one another, stood from the bottom section 50, and elongated along the X axis. The rearward end section 52 is stood from the bottom section 30 and elongated along the Y axis.

The pair of rails 54 are formed on the bottom section 50 and elongated along the X axis. The plurality of ratchet teeth 55 are disposed between the pair of rails 54, along the X axis. The rearward end guide 53 is stood along the rearward end section 52. The rearward end guide 53 is movable along the rails 54. Engagement pawls 56 are formed in a lower part of the rearward end guide 53. The engagement pawls 56 can engage with the ratchet teeth 55 and disengage from the ratchet teeth 55. Thus, the rearward end guide 53 can be fixed at any location along the rails 54.

A lower surface of the bottom section 50 of the sliding cassette 5 faces the upper surface of the bottom section 30 of the main cassette 3. More specifically, the sliding cassette 5 is attached to the main cassette 3 such that the bottom section 50 is disposed over the bottom section 30 in a region where the sliding cassette 5 overlaps the main cassette 3. A plurality of sheets are stacked on one another in the positive direction of the Z axis over a loading surface including the upper surface of the bottom section 30, an upper surface of the lift plate 35, and an upper surface of the bottom section 50. More specifically, a forward end side of the sheets is placed over the upper surface of the bottom section 30 and the upper surface of the lift plate 35, whereas a rearward end side of the sheets is placed over the upper surface of the bottom section 50. The pair of side end guides 34 and the rearward end guide 53 are moved according to the size of the sheets to be placed.

[Structure of Manipulation Section 70]

Structural detail of the manipulation section 70 will be described with reference to FIGS. 2 and 3. As illustrated in FIGS. 2 and 3, the manipulation section 70 is integrally formed with the bottom section 50. It should be noted that the manipulation section 70 may be prepared as a member separate from the bottom section 50 and coupled to the bottom section 50. The manipulation section 70 has a plate-like shape and includes the level lever portion 71 and the base end portion 72 inclined relative to the lever portion 71. The lever portion 71 has a circular through hole 74. The through hole 74 penetrates through an upper surface and a lower surface of the lever portion 71. The manipulation section 70 has a second opposed region 77 that is opposed to a first opposed region 37 according to a position of the manipulation section 70. The lower surface of the lever portion 71 is the second opposed region 77. The second protrusion 78*a* is formed in the second opposed region 77. It should be noted that the main cassette 3 has the first opposed region 37 that is opposed to the manipulation section 70 according to the position of the manipulation section 70. The first protrusion 38*a* is formed in the first opposed region 37.

One end portion (rearward end portion) of the base end portion 72 is connected with a linear end portion (forward end portion) of the lever portion 71. The other end portion (forward end portion) of the base end portion 72 is connected with the bottom section 50. The base end portion 72 is inclined downward in the extending direction Al from the bottom section 50. Accordingly, the lever portion 71 is disposed at a location lower than the loading surface of the bottom section 50 by a distance d. As a result, sheets can be prevented from coming into contact with the manipulation section 70 when loaded on the loading surface. Thus, a plurality of sheets P can be loaded in a flat state while preventing creasing or damage of the sheets P.

[Shift in Posture of Manipulation Section 70]

Shift in posture of the manipulation section 70 will be described with reference to FIGS. 3 to 6. The lever portion 71 of the manipulation section 70 is shiftable from the lying down posture (see FIG. 3) to the tilted posture (see FIG. 4) in which the lever portion 71 is tilted relative to the first opposed region 37. The shift of the lever portion 71 from the lying down posture to the tilted posture releases the engagement between the first protrusion 38*a* and the second protrusion 78*a*. Hereinafter, detailed description will be provided. The lever portion 71 extends from the base end portion 72 in the extending direction A1. The base end portion 72 is elastic. The lever portion 71 is therefore swingable about the base end portion 72 in a direction intersecting with the bottom section 30 of the main cassette 3. More specifically, a curved end portion (rearward end portion) of the lever portion 71 is a free end portion. A position of the curved end portion can therefore be changed in the direction intersecting with the bottom section 30 relative to the base end portion 72 as an axis. The direction intersecting with the bottom section 30 is the upward direction or the downward direction.

Figure 5:
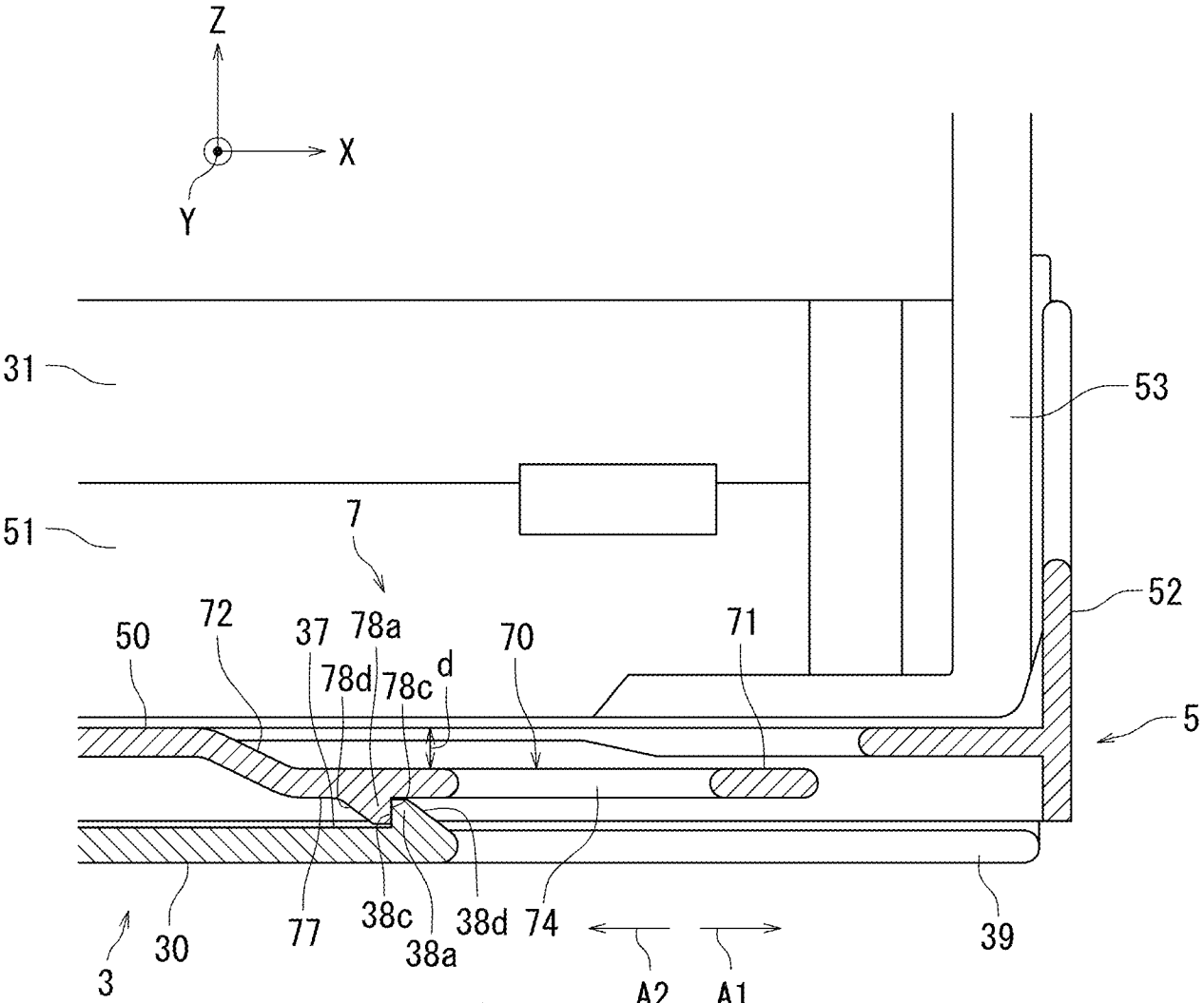
FIG. 5 is a cross-sectional view illustrating the restricting section of the cassette according to the first embodiment of the present invention (lying down posture).

FIG. 5 is a cross-sectional view illustrating the manipulation section 70 in the lying down posture. As illustrated in FIGS. 3 and 5, the lever portion 71 is in the lying down posture in the absence of external force to the lever portion 71. The lever portion 71 in the lying down posture lies between the bottom section 30 and the bottom section 50 and substantially parallel to the bottom section 30 and the bottom section 50.

Figure 6:
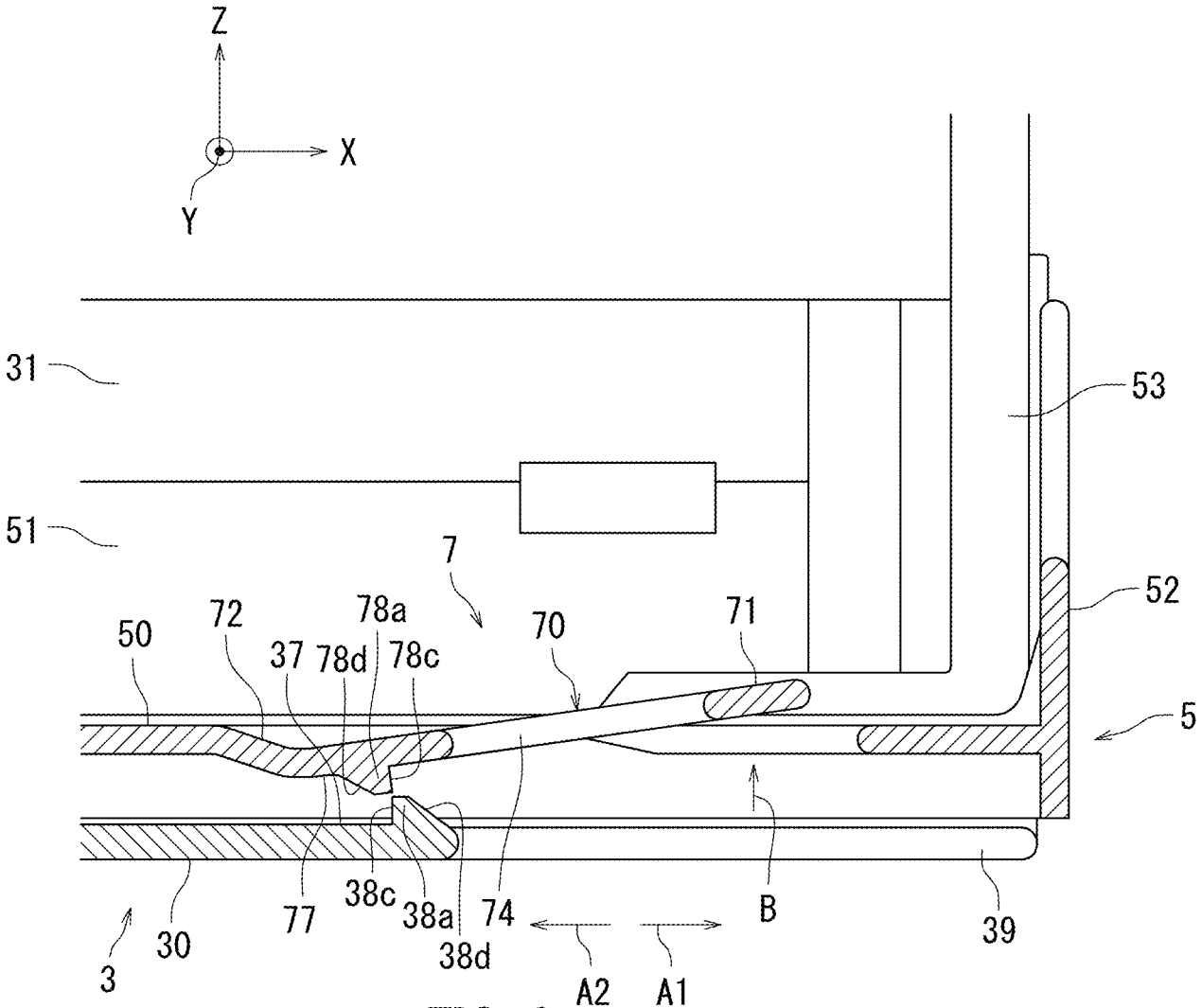
FIG. 6 is a cross-sectional view illustrating the restricting section of the cassette according to the first embodiment of the present invention (tilted posture).

FIG. 6 is a cross-sectional view illustrating the lever portion 71 in the tilted posture. As illustrated in FIGS. 4 and 6, the lever portion 71 is in the tilted posture when external force in the upward direction B is applied to the curved end portion of the lever portion 71 to pull up the curved end portion. Once the external force is released, the lever portion 71 returns into the lying down posture due to the elasticity of the base end portion 72.

A user can put a finger in the through hole 74, catch the curved end portion of the lever portion 71 with the finger, and pull up the curved end portion. As a result, the user can put the lever portion 71 in the tilted posture. The user can then release the finger from the lever portion 71 or relax the force thereby to return the lever portion 71 from the tilted posture to the lying down posture.

[Structures of First Protrusion 38*a* and Second Protrusion 78*a]*

Structures of the first protrusion 38*a* and the second protrusion 78*a* will be described with reference to FIGS. 5 and 6. The first protrusion 38*a* protrudes from the bottom section 30 of the main cassette 3. More specifically, the first protrusion 38*a* protrudes from the first opposed region 37. The first protrusion 38*a* has an engagement surface 38*c* (first engagement surface) and an inclined surface 38*d* (first inclined surface). The inclined surface 38*d* faces toward the engagement surface 38*c*. The inclined surface 38*d* is inclined upward in the contracting direction A2 from the first opposed region 37. The second protrusion 78*a* protrudes from the forward end portion of the lever portion 71 toward the first protrusion 38*a*. More specifically, the second protrusion 78*a* protrudes from the second opposed region 77. The second protrusion 78*a* has an engagement surface 78*c* (second engagement surface) and an inclined surface 78*d* (second inclined surface). The inclined surface 78*d* faces toward the engagement surface 78*c*. The inclined surface 78*d* is inclined downward in the extending direction A1 from the second opposed region 77.

[Restriction of Sliding of Sliding Cassette 5]

Restriction of the sliding of the sliding cassette 5 will be described with reference to FIGS. 3 and 5. While the lever portion 71 is in the lying down posture in an engagement position, the first protrusion 38*a* and the second protrusion 78*a* are in engagement. The engagement position is a position where the first protrusion 38*a* and the second protrusion 78*a* face toward one another. More specifically, the engagement surface 38*c* and the engagement surface 78*c* engage with one another. Accordingly, the sliding of the sliding cassette 5 in the extending direction A1 is restricted. The position of the sliding cassette 5 with the first protrusion 38*a* and the second protrusion 78*a* in engagement is a position where the sliding cassette 5 is pushed in the contracting direction A2 to the maximum. Accordingly, the sliding cassette 5 is locked in a position where the size of the cassette 1 is a minimum size.

[Removal of Restriction of Sliding of Sliding Cassette 5]

Removal of restriction of the sliding of the sliding cassette 5 will be described with reference to FIGS. 4 and 6. Once external force in the upward direction B is applied to the curved end portion of the lever portion 71 with the first protrusion 38*a* and the second protrusion 78*a* in engagement, and thus the lever portion 71 is put in the tilted posture, the second protrusion 78*a* is separated from the first protrusion 38*a*, releasing the engagement therebetween. Thus, restriction of the sliding of the sliding cassette 5 is removed. That is, the sliding cassette 5 is unlocked. When external force in the extending direction A1 is subsequently applied to the lever portion 71, the sliding cassette 5 is slid in the extending direction A1. The sliding cassette 5 is drawn in the extending direction A1 to the maximum and locked in a position where the size of the cassette 1 is a maximum size.

A user for example extends the size of the cassette 1 according to the following procedure. The user puts a finger in the through hole 74, catches the curved end portion of the lever portion 71 with the finger, and pulls up the curved end portion. As a result, the lever portion 71 is put in the tilted posture, the engagement is released, and the restriction of the sliding is removed. Subsequently to the removal of the restriction of the sliding, the user catches a rear-side opening edge of the through hole 74 with a finger and pulls the finger in the extending direction A1. Consequently, the sliding cassette 5 can be drawn, and the size of the cassette 1 can be extended. The sliding cassette 5 comes to a stop after being drawn by a prescribed distance. For example, the bottom section 50 has a pair of protrusions (not shown). Once the sliding cassette 5 is drawn by the prescribed distance, the pair of protrusions engage with rearward ends of the pair of side end sections 31. As a result, the sliding cassette 5 comes to a stop.

A user for example contracts the size of the cassette 1 according to the following procedure. The user pushes in the sliding cassette 5 in the contracting direction A2 until the second protrusion 78*a* engages with the first protrusion 38*a*. Since the first protrusion 38*a* has the inclined surface 38*d* and the second protrusion 78*a* has the inclined surface 78*d*, the second protrusion 78*a* can smoothly engage with the first protrusion 38*a* as a result of the sliding of the sliding cassette 5 in the contracting direction A2.

[Structure of Cutout Portion 39]

A structure of the cutout portion 39 will be described with reference to FIGS. 2 and 3. The bottom section 30 of the main cassette 3 has the cutout portion 39. More specifically, the cutout portion 39 extends from a specified location in the bottom section 30 to a rearward end of the bottom section 30. In the first embodiment, the cutout portion 39 is formed by cutting out a U-shaped portion from a rearward end portion of the bottom section 30. The cutout portion 39 is formed commensurate with a region of movement of the through hole 74 in accompaniment to the sliding of the sliding cassette 5. Accordingly, the through hole 74 moves above the cutout portion 39 in accompaniment to the sliding of the sliding cassette 5 in the extending direction A1 or in the contracting direction A2. As a result, the user can avoid contact of their finger with the bottom section 30 of the main cassette 3 and slide the sliding cassette 5 without pulling the finger out of the through hole 74.

According to the first embodiment, as described with reference to FIGS. 1 to 6, a user can slide out the sliding cassette 5 by pulling the lever portion 71 in the extending direction A1 subsequently to unlocking the sliding cassette 5 by manipulating the lever portion 71. That is, the unlocking of the sliding cassette 5 and the sliding of the sliding cassette 5*a* can be performed by a series of manipulation actions on the lever portion 71. Consequently, the size of the cassette 1 can be adjusted by simple manipulation.

According to the first embodiment, the first protrusion 38*a* may be integrally formed with the main cassette 3, and the manipulation section 70 and the second protrusion 78*a* may be integrally formed with the sliding cassette 5 as described with reference to FIGS. 3 and 4. It is therefore possible to form a mechanism for unlocking the sliding cassette 5 with a reduced number of elements.

Furthermore, according to the first embodiment, the locking and the unlocking of the sliding cassette 5 can be easily performed using the first protrusion 38*a* and the second protrusion 78*a* as described with reference to FIGS. 3 and 4.

Furthermore, according to the first embodiment, the manipulation section 70 has the through hole 74 penetrating through the second opposed region 77 and a region of the manipulation section 70 that is opposite to the second opposed region 77 as described with reference to FIG. 2. Accordingly, a user can readily unlock the sliding cassette 5 by putting a finger in the through hole 74 and pulling up the lever portion 71.

(Second Embodiment)

The cassette 1 according to the second embodiment of the present invention will be described with reference to FIGS. 1, 2, and 7 to 9. Configuration of the cassette 1 according to the second embodiment is the same as the configuration of the cassette 1 according to the first embodiment except a part of the restricting section 7. Hereinafter, a difference between the second embodiment and the first embodiment will be mainly described.

Figure 7:
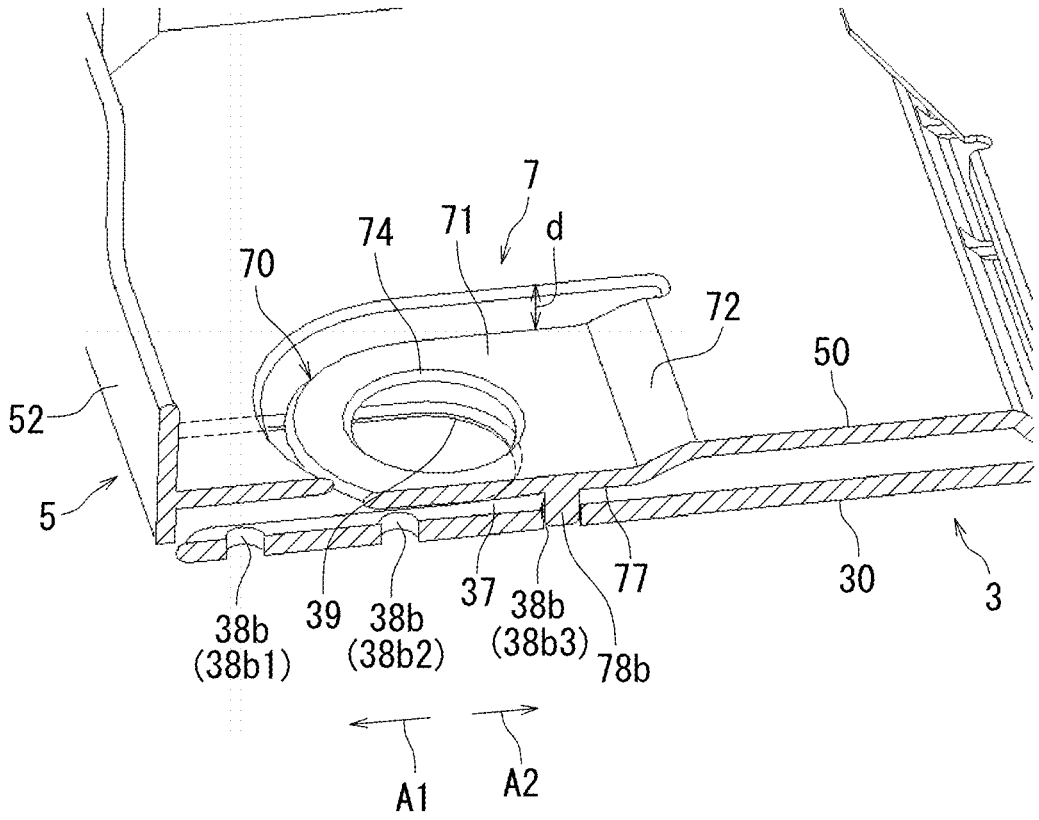
FIG. 7 is a perspective cross-sectional view illustrating a restricting section of a cassette according to a second embodiment of the present invention (engaged state and small size).
Figure 8:
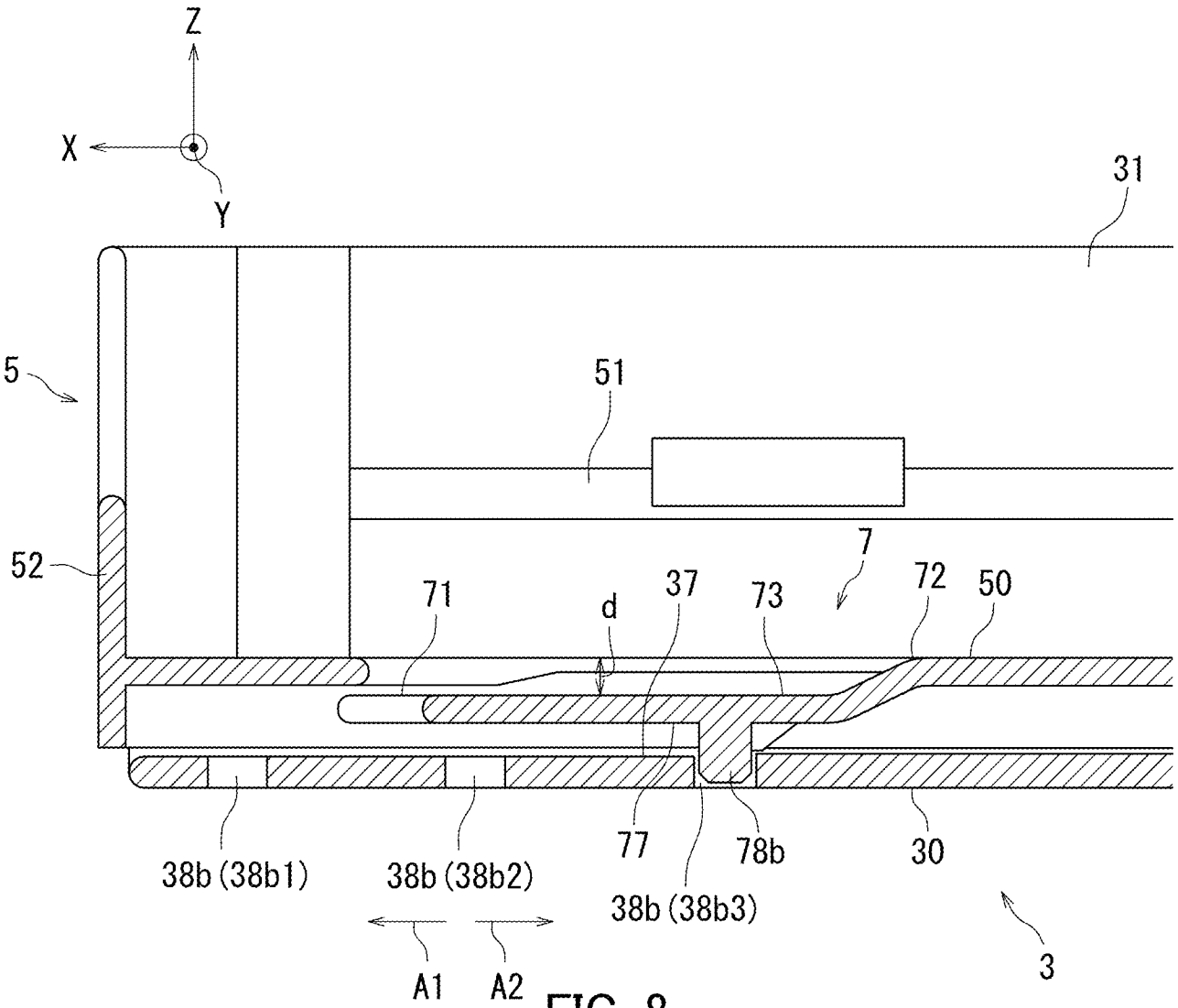
FIG. 8 is a cross-sectional view illustrating the restricting section of the cassette according to the second embodiment of the present invention (engaged state and small size).

FIGS. 7 and 8 are a perspective cross-sectional view and a cross-sectional view, respectively, each illustrating an engaged state of the restricting section 7 in the cassette 1 adjusted to a small size. The restricting section 7 includes a plurality of engagement hole portions 38*b* (a plurality of first engagement sections or a plurality of openings), the manipulation section 70, and an engagement protrusion 78*b* (a second engagement section or a protrusion). In the second embodiment, the plurality of engagement hole portions38*b* are provided instead of the first protrusion 38*a* (see FIG. 3)

of the first embodiment, and the engagement protrusion 78*b* is provided instead of the second protrusion 78*a* (see FIG. 3) of the first embodiment.

The engagement hole portions 38*b* function as locking portions. The plurality of engagement hole portions 38*b* are three engagement hole portions 38*b* in the second embodiment. Of the three engagement hole portions 38*b*, an engagement hole portion 38*b* closest to the rearward end of the bottom section 30 may be referred to as an engagement hole portion 38*b*1, an engagement hole portion 38*b* adjacent to the engagement hole portion 38*b*1 may be referred to as an engagement hole portion 38*b*2, and an engagement hole portion 38*b* farthest from the rearward end of the bottom section 30 may be referred to as an engagement hole portion 38*b*3. The configuration of the manipulation section 70 is the same as the configuration of the manipulation section 70 (see FIG. 3) of the first embodiment.

The plurality of engagement hole portions 38*b* are formed in the bottom section 30 of the main cassette 3. More specifically, the plurality of engagement hole portions 38*b* are formed in the first opposed region 37. In the second embodiment, each of the plurality of engagement hole portions 38*b* is a circular through hole. Alternatively, each of the plurality of engagement hole portions 38*b* may be a bottomed recess. The plurality of engagement hole portions 38*b* are arranged along a sliding direction of the sliding cassette 5. The sliding direction is the extending direction A1 or the contracting direction A2. Locations of the engagement hole portions 38*b* are determined according to a maximum size of sheets that can be loaded in the cassette 1 while the engagement protrusion 78*b* and the engagement hole portion 38*b* are in engagement. The engagement protrusion 78*b* protrudes from the forward end portion of the lever portion 71 toward the engagement hole portions 38*b*. More specifically, the engagement protrusion 78*b* protrudes from the second opposed region 77. The engagement protrusion 78*b* is a protrusion having a cylindrical shape that can mate with each of the engagement hole portions 38*b*. The engagement hole portions 38*b* therefore have a slightly larger diameter than a diameter of the engagement protrusion 78*b*.

First, restriction of sliding by engagement (mating) between the engagement hole portions 38*b* and the engagement protrusion 78*b* will be described. While the lever portion 71 of the manipulation section 70 is in the lying down posture in the engagement position, the engagement protrusion 78*b* is in engagement with one of the engagement hole portions 38*b*. The engagement position is a position where the engagement hole portions 38*b* and the engagement protrusion 78*b* face toward one another. More specifically, the engagement protrusion 78*b* is mating with one of the engagement hole portions 38*b*. Accordingly, the sliding of the sliding cassette 5 in the extending direction A1 and in the contracting direction A2 is restricted, and the sliding cassette 5 is locked. In the second embodiment, the term engagement and the term mating have the same meaning.

Since there are three engagement hole portions 38*b*1 to 38*b*3 in the second embodiment, the cassette 1 is adjustable to three different sizes. The three different sizes are a large size, a medium size, and a small size.

The small size of the cassette 1 will be described with reference to FIGS. 7 and 8. The engagement protrusion 78*b* is mating with the engagement hole portion 38*b*3 with the lever portion 71 in the lying down posture. Accordingly, the sliding cassette 5 is in a position where the sliding cassette 5 is pushed in the contracting direction A2 to the maximum. As a result, the sliding cassette 5 is locked in a position where the cassette 1 is in the small size.

Figure 9:
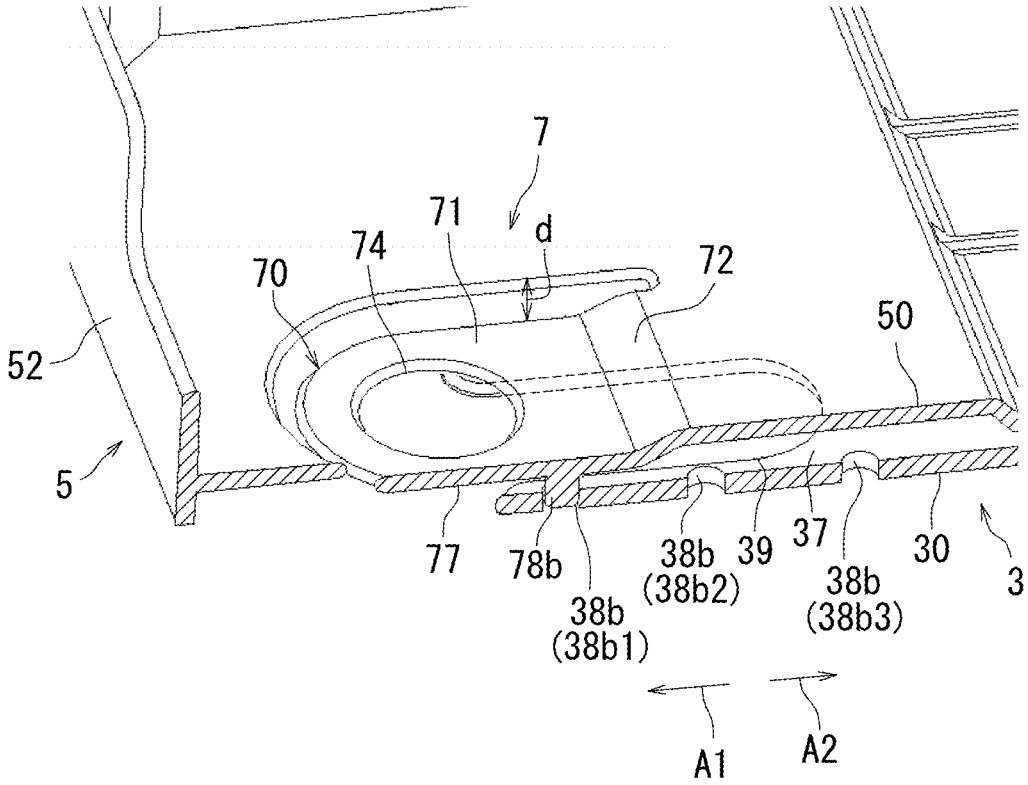
FIG. 9 is a perspective cross-sectional view illustrating the restricting section of the cassette according to the second embodiment of the present invention (engaged state and large size).

The large size of the cassette 1 will be described with reference to FIG. 9. FIG. 9 is a perspective cross-sectional view illustrating an engaged state of the restricting section 7 in the cassette 1 adjusted to the large size. The engagement protrusion 78*b* is mating with the engagement hole portion 38*b*1 with the lever portion 71 in the lying down posture. The sliding cassette 5 is therefore in a position where the sliding cassette 5 is drawn out in the extending direction A1 to the maximum. As a result, the sliding cassette 5 is locked in a position where the cassette 1 is in the large size.

Although not shown, the sliding cassette 5 is locked in a position where the cassette 1 is in a medium size when the engagement protrusion is mating with the engagement hole portion 38*b*2 with the lever portion 71 in the lying down posture.

Next, removal of restriction of the sliding by releasing the engagement (releasing the mating) between the engagement hole portions 38*b* and the engagement protrusion 78*b* will be described. FIGS. 7 and 8 will be used. Once external force in an upward direction (corresponding to the upward direction B in FIG. 4) is applied to the curved end portion of the lever portion 71 with the engagement protrusion 78*b* and one engagement hole portion 38*b* in engagement, and thus the lever portion 71 is put in the tilted posture, the engagement protrusion 78*a* is pulled out of the engagement hole portion 38*b*, releasing the mating therebetween. Thus, restriction of the sliding of the sliding cassette 5 is removed. That is, the sliding cassette 5 is unlocked.

When external force in the extending direction A1 is subsequently applied to the lever portion 71, the sliding cassette 5 slides in the extending direction A1. Once the lever portion 71 is put in the lying down posture after the sliding cassette 5 has been drawn in the extending direction A1, the engagement protrusion 78*b* mates with another engagement hole portion 38*b*. As a result, the sliding is once again restricted, and the sliding cassette 5 is locked.

When external force in the contracting direction A2 is applied to the lever portion 71 after the releasing of the mating, the sliding cassette 5 is slid in the contracting direction A2. Once the lever portion 71 is put in the lying down posture after the sliding cassette 5 has been pushed in the contracting direction A2, the engagement protrusion 78*b* mates with yet another engagement hole portion 38*b*. As a result, the sliding is re-restricted, and the sliding cassette 5 is locked.

A user for example extends or contracts the size of the cassette 1 according to the following procedure. The user puts a finger in the through hole 74, catches the curved end portion of the lever portion 71 with the finger, and pulls up the curved end portion. As a result, the lever portion 71 is put in the tilted posture, the mating of the engagement protrusion 78*b* with one engagement hole portion 38*b* is released, and the restriction of the sliding is removed. Subsequently to the removal of the restriction of the sliding, the user catches the rear-side opening edge of the through hole 74 with a finger and pulls the finger in the extending direction A1 or pushes the curved end portion of the lever portion 71 in the contracting direction A2. As a result, the sliding cassette 5 is drawn out or pushed in. The user subsequently causes the engagement protrusion 78*b* to mate with another engagement hole portion 38*b*, thereby locking the sliding cassette 5 and extending or contracting the size of the cassette 1.

According to the second embodiment, as described above with reference to FIGS. 1, 2, and 7 to 9, the unlocking of the sliding cassette 5 and the sliding of the sliding cassette 5 can be performed by a series of manipulation actions on the lever portion 71. Consequently, the size of the cassette 1 can be adjusted by simple manipulation. The second embodiment further produces the following effect in addition to the same effect as produced by the first embodiment.

That is, according to the second embodiment, the engagement hole portions 38*b* are formed by processing the main cassette 3, and the manipulation section 70 and the engagement protrusion 78*b* can be integrally formed with the sliding cassette 5 as described with reference to FIG. 7. It is therefore possible to form a mechanism for unlocking the sliding cassette 5 with a reduced number of elements.

Furthermore, the second embodiment includes a plurality of engagement hole portions 38*b* as described with reference to FIGS. 7 and 9. The plurality of engagement hole portions 38*b* are arranged along the sliding direction of the sliding cassette 5. Accordingly, the cassette 1 is adjustable to a plurality of different sizes.

Furthermore, according to the second embodiment, the engagement protrusion 78*b* and the engagement hole portions 38*b* allow the locking and the unlocking of the sliding cassette 5 to be readily performed as described with reference to FIG. 7.

(Third Embodiment)

Figure 10:
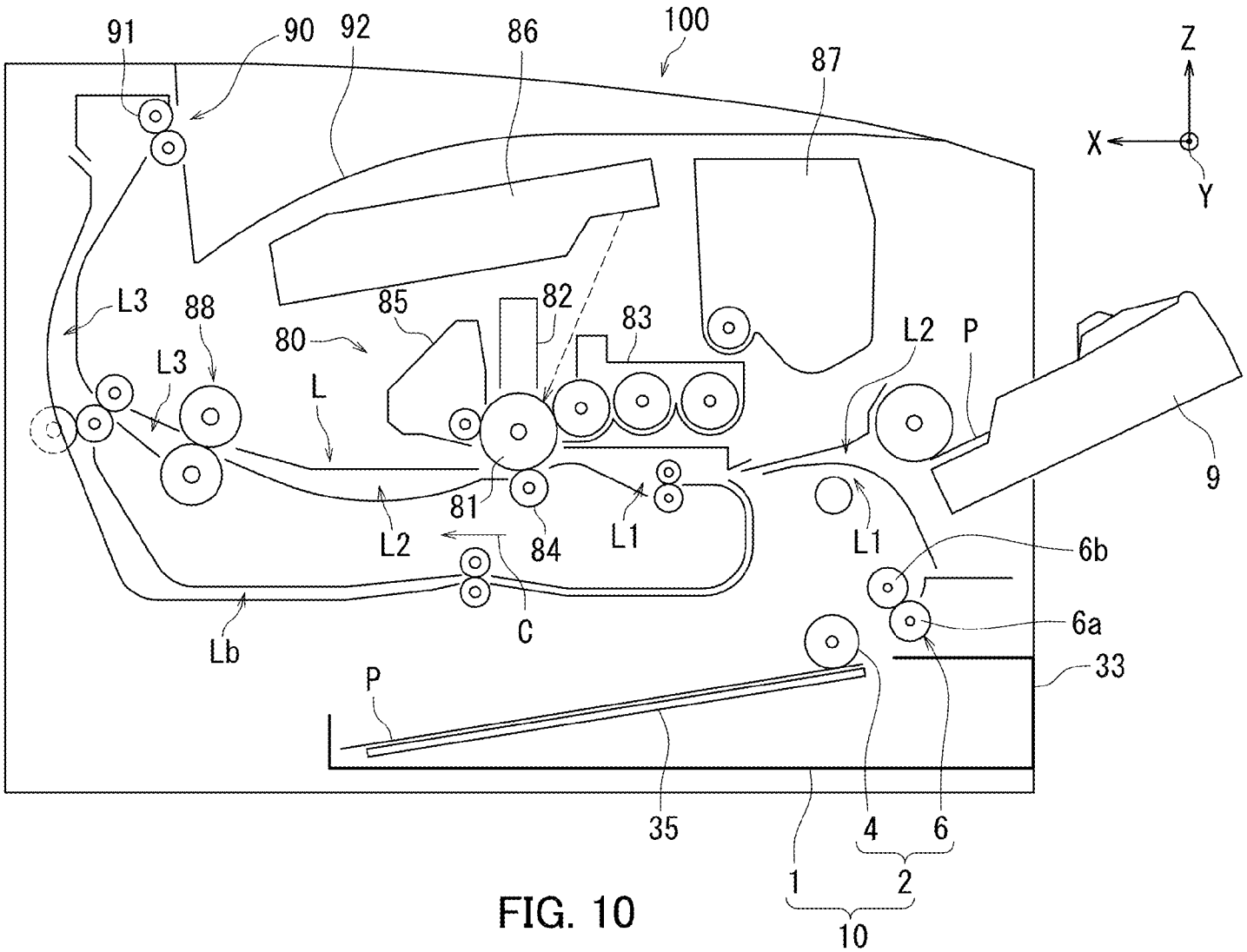
FIG. 10 is a schematic cross-sectional view for illustrating an overview of an image forming apparatus according to a third embodiment of the present invention.

An image forming apparatus 100 according to the third embodiment of the present invention will be described with reference to FIGS. 1, 3, 7, and 10. FIG. 10 is a schematic cross-sectional view for illustrating an overview of the image forming apparatus 100. The image forming apparatus 100 is for example a copier, a printer, or a multifunction peripheral. A multifunction peripheral for example has at least two of a copier, a printer, and a facsimile machine. Hereinafter, an example in which the image forming apparatus 100 is a printer will be described.

The image forming apparatus 100 includes a feeder 10, an image forming section 80, and a discharge section 90. The image forming apparatus 100 also has a conveyance path L. The conveyance path L includes conveyance paths L1 to L3 and a conveyance path Lb.

The feeder 10 includes the cassette 1, a feeding section 2, and a manual feed tray 9. The cassette 1 is the cassette 1 according to the first embodiment or the cassette 1 according to the second embodiment. The cassette 1 is disposed in a lower part of the image forming apparatus 100. The cassette 1 is drawable from a front surface of the image forming apparatus 100 in a negative direction of the X axis along the X axis. The panel 33 of the cassette 1 forms a portion of the front surface of the image forming apparatus 100.

The feeding section 2 feeds the sheets P loaded in the cassette 1. More specifically, the feeding section 2 includes a pickup roller 4 and a pair of feeding rollers 6. The pair of feeding rollers 6 include a retard roller 6*a* and a feed roller 6*b*. The pickup roller 4 feeds the sheets P loaded in the cassette 1 to the pair of feeding rollers 6 while rotating.

The pair of feeding rollers 6 prevent multiple feeding of sheets P and feed the sheets P to the conveyance path L1 one at a time. More specifically, the feed roller 6*b* feeds the sheets P while rotating. When receiving one sheet P, the retard roller 6*a* is driven to rotate by the feed roller 6*b*. When receiving a plurality of sheets P stuck on one another, on the contrary, the retard roller 6*a* rotates in a direction opposite to a direction for feeding the sheets P or stops to separate a sheet P in contact with the feed roller 6*b* from another sheet P. As a result, one sheet P is fed by the feed roller 6*b*. The sheet P is conveyed to the image forming section 80 along the conveyance path L1. Sheets P are also loaded on the manual feed tray 9. The sheets P are fed from the manual feed tray 9 to the conveyance path L2 and further fed to the conveyance path L1. The sheets P are conveyed to the image forming section 80 along the conveyance path L1.

The image forming section 80 forms an image on a sheet P fed by the feeder 10. More specifically, the image forming section 80 includes a photosensitive drum 81, a charger 82, a development section 83, a transfer section 84, a cleaning section 85, a light exposure section 86, a toner cartridge 87, and a fixing section 88.

The photosensitive drum 81 rotates in a direction along a conveyance direction C of the sheets P. The charger 82 charges a surface of the photosensitive drum 81. The light exposure section 86 irradiates the surface of the photosensitive drum 81 with light based on image data. As a result, an electrostatic latent image based on the image data is formed on the surface of the photosensitive drum 81. The development section 83 attaches toner to the electrostatic latent image to form a toner image on the surface of the photosensitive drum 81. The toner cartridge 87 contains the toner and supplies the toner to the development section 83.

The transfer section 84 presses the sheet P against the surface of the photosensitive drum 81 to transfer the toner image onto the sheet P. The sheet P having the toner image transferred thereon is conveyed to the fixing section 88 along the conveyance path L2. The fixing section 88 applies heat and pressure to the sheet P to fix the toner image on the sheet P. The sheet P on which the toner image has been fixed by the fixing section 88 is conveyed to the discharge section 90 along the conveyance path L3. The cleaning section 85 removes toner left on the surface of the photosensitive drum 81.

The discharge section 90 includes a pair of discharge rollers 91 and an exit tray 92. The pair of discharge rollers 91 discharge the sheet P conveyed thereto along the conveyance path L3 to the exit tray 92. When duplex printing is to be performed, the sheet P conveyed to the conveyance path L3 is returned into the conveyance path L1 along the conveyance path Lb. The sheet P is for example plain paper, recycled paper, thin paper, thick paper, or an overhead projector (OHP) sheet.

According to the third embodiment, as described above, the image forming apparatus 100 includes the cassette 1 according to the first embodiment or the cassette 1 according to the second embodiment. A user can therefore perform the unlocking and the sliding by a series of manipulation actions on the lever portion 71. Consequently, the size of the cassette 1 can be adjusted by simple manipulation. Other than that, the third embodiment produces the same effects as the first embodiment and the second embodiment.

The embodiments of the present invention have been described so far with reference to FIGS. 1 to 10. However, the present invention is not limited to the above-described embodiments and can be practiced in various ways within the scope without departing from the essence of the present invention. For example, the following alterations may be made.

(1) The first embodiment includes a single first protrusion 38*a*. Alternatively, a plurality of first protrusions 38*a* may be formed. In this case, the plurality of protrusions 38*a* are arranged parallel to the sliding direction of the sliding cassette 5 as in the case of the plurality of engagement hole portions 38*b* according to the second embodiment. Thus, the cassette 1 is adjustable to a plurality of different sizes.

(2) The engagement between the first protrusion 38*a* and the second protrusion 78*a* is released or the engagement between the engagement hole portion 38*b* and the engagement protrusion 78*b* is released by pulling up the lever portion 71 in the upward direction B in the first embodiment to the third embodiment. Alternatively, a configuration in which the engagement is released by pushing down the manipulation section 70 may be employed as long as that is feasible.

(3) The first protrusion 38*a* is disposed on the bottom section 30 of the main cassette, and the manipulation section 70 and the second protrusion 78*a* are disposed on the bottom section 50 of the sliding cassette 5 in the first embodiment to the third embodiment. Alternatively, the first protrusion 38*a* may be disposed on one of the side end sections 31 of the main cassette, and the manipulation section 70 and the second protrusion 78*a* may be disposed on one of the side end sections 51 of the sliding cassette 5.

The engagement hole portions 38*b* are disposed in the bottom section 30 of the main cassette, and the manipulation section 70 and the engagement protrusion 78*b* are disposed on the bottom section 50 of the sliding cassette 5 in the second embodiment and the third embodiment. Alternatively, the engagement hole portions 38*b* may be disposed in one of the side end sections 31 of the main cassette, and the manipulation section 70 and the engagement protrusion 78*b* may be disposed on one of the side end sections 51 of the sliding cassette 5.

(4) A plurality of protrusions may be formed instead of the plurality of engagement hole portions 38*b*, and an engagement hole portion may be formed instead of the engagement protrusion 78*b* in the second embodiment and the third embodiment.

(5) The cutout portion 39 is formed in the bottom section 30 of the main cassette 3 in the first embodiment to the third embodiment. Alternatively, the main cassette 3 may have a through hole instead of the cutout portion 39. More specifically, the through hole is formed in the bottom section 30 so as to be commensurate with the region of movement of the through hole 74 in accompaniment to the sliding of the sliding cassette 5. A user can therefore slide the sliding cassette 5 without pulling their finger out of the through hole 74.

(6) The sliding cassette 5 is attached to the main cassette 3 such that the bottom section 50 is disposed over the bottom section 30 in the region where the sliding cassette 5 overlaps the main cassette 3 in the first embodiment to the third embodiment. Alternatively, the sliding cassette 5 may be attached to the main cassette 3 such that the bottom section 50 is disposed under the bottom section 30 in the region where the sliding cassette 5 overlaps the main cassette 3. In this case, the first opposed region 37 is located on a lower surface of the bottom section 30, and the second opposed region 77 is located on the upper surface of the bottom section 50. Accordingly, the first protrusion 38*a* is formed in the first opposed region 37, and the second protrusion 78*a* is formed in the second opposed region 77. Alternatively, the engagement hole portions 38*b* are formed in the first opposed region 37, and the engagement protrusion 78*b* is formed in the second opposed region 77.

(7) The sheet conveyance direction in the cassette 1 is substantially the same as the contracting direction A2 in the first embodiment to the third embodiment. Alternatively, the sheet conveyance direction may be different from the contracting direction A2. For example, the sheet conveyance direction may be substantially perpendicular to the contracting direction A2.

INDUSTRIAL APPLICABILITY

The present invention is applicable to the fields of cassettes in which a plurality of sheets are loaded, and of feeders and image forming apparatuses including the cassettes.

The invention claimed is:

1. A cassette configured to receive loading of a plurality of sheets and to be extendable in a first direction, the cassette comprising:

a first sheet accommodation section;

a second sheet accommodation section configured to be slidably attached to the first sheet accommodation section; and a restricting section configured to restrict sliding of the second sheet accommodation section, wherein the restricting section includes:

at least one first engagement section disposed in the first sheet accommodation section;

a manipulation section disposed in the second sheet accommodation section; and a second engagement section disposed in the manipulation section and configured to engage with the first engagement section, the manipulation section has a base end portion connected with the second sheet accommodation section and a lever portion continuous from the base end portion, the lever portion is shiftable from a lying down posture to a tilted posture when so manipulated, the second engagement section is disposed in the lever portion, shift of the lever portion from the lying down posture to the tilted posture releases engagement between the first engagement section and the second engagement section, and allows the lever portion to be pulled in the first direction to slide the second sheet accommodation section and extend a size of the cassette, the lever portion has a through hole, and a bottom of the first sheet accommodation section has a cutout portion that is corresponding to a region of movement of the through hole in accompaniment to the sliding of the second sheet accommodation section.

2. The cassette according to claim 1, wherein the first engagement section is a first protrusion protruding from a bottom of the first sheet accommodation section, the second engagement section is a second protrusion protruding from a forward end of the lever portion toward the first protrusion, and the forward end of the lever portion is a forward end in a second direction opposite to the first direction in the lever portion.

3. The cassette according to claim 1, wherein the first engagement section is an engagement hole portion in a bottom of the first sheet accommodation section, the second engagement section is an engagement protrusion protruding from a forward end of the lever portion toward the engagement hole portion, the forward end of the lever portion is a forward end in a second direction opposite to the first direction in the lever portion, and the engagement protrusion is configured to mate with the engagement hole portion.

4. The cassette according to claim 1, wherein the at least one first engagement section is a plurality of first engagement sections, and the plurality of first engagement sections are arranged in a sliding direction of the second sheet accommodation section.

5. The cassette according to claim 1, wherein the base end portion of the manipulation section is connected with a bottom of the second sheet accommodation section, and the lever portion of the manipulation section is disposed at a location in the bottom, the location being lower than a surface on which the sheets are loaded.

6. The cassette according to claim 5, wherein the base end portion of the manipulation section is inclined downward in the first direction from the bottom of the second sheet accommodation section.

7. The cassette according to claim 1, wherein the cutout portion extends from a specified location in the bottom of the first sheet accommodation section to a rearward end of the bottom, the rearward end of the bottom is a rearward end in a second direction opposite to the first direction in the bottom, the second sheet accommodation section is configured to be attached to the first sheet accommodation section such that a bottom of the second sheet accommodation section is disposed over the bottom of the first sheet accommodation section, and the through hole of the lever portion moves above the cutout portion in accompaniment to the sliding of the second sheet accommodation section.

8. A feeder comprising:

the cassette according to claim 1; and a feeding section configured to feed a sheet from the sheets in the cassette.

9. An image forming apparatus comprising:

the feeder according to claim 8; and an image forming section configured to form an image on the sheet fed by the feeder.

10. A cassette configured to receive loading of a plurality of sheets and to be extendable in a first direction, the cassette comprising:

a first sheet accommodation section;

a second sheet accommodation section configured to be slidably attached to the first sheet accommodation section; and a restricting section configured to restrict sliding of the second sheet accommodation section, wherein the restricting section includes:

at least one first engagement section disposed in the first sheet accommodation Section;

a manipulation section disposed in the second sheet accommodation section; and a second engagement section disposed in the manipulation section and configured to engage with the first engagement section, the manipulation section has a base end portion connected with the second sheet accommodation section and a lever portion continuous from the base end portion, the lever portion is shiftable from a lying down posture to a tilted posture when so manipulated, the second engagement section is disposed in the lever portion, shift of the lever portion from the lying down posture to the tilted posture releases engagement between the first engagement section and the second engagement section, and allows the lever portion to be pulled in the first direction to slide the second sheet accommodation section and extend a size of the cassette, and the lever portion extends from the base end portion in the first direction and is swingable about the base end portion in a direction intersecting with a bottom of the first sheet accommodation section.

11. The cassette according to claim 10, wherein the first engagement section is a first protrusion protruding from a bottom of the first sheet accommodation section, the second engagement section is a second protrusion protruding from a forward end of the lever portion toward the first protrusion, and the forward end of the lever portion is a forward end in a second direction opposite to the first direction in the lever portion.

12. The cassette according to claim 10, wherein the first engagement section is an engagement hole portion in a bottom of the first sheet accommodation section, the second engagement section is an engagement protrusion protruding from a forward end of the lever portion toward the engagement hole portion, the forward end of the lever portion is a forward end in a second direction opposite to the first direction in the lever portion, and the engagement protrusion is configured to mate with the engagement hole portion.

13. The cassette according to claim 10, wherein the base end portion of the manipulation section is connected with a bottom of the second sheet accommodation section, and the lever portion of the manipulation section is disposed at a location in the bottom, the location being lower than a surface on which the sheets are loaded.

14. The cassette according to claim 13, wherein the base end portion of the manipulation section is inclined downward in the first direction from the bottom of the second sheet accommodation section.

15. A feeder comprising:

the cassette according to claim 10; and a feeding section configured to feed a sheet from the sheets in the cassette.

16. A cassette configured to receive loading of a plurality of sheets and to be extendable in a first direction, the cassette comprising:

a first sheet accommodation section;

a second sheet accommodation section configured to be slidably attached to the first sheet accommodation section; and a restricting section configured to restrict sliding of the second sheet accommodation section, wherein the restricting section includes:

at least one first engagement section disposed in the first sheet accommodation Section;

a manipulation section disposed in the second sheet accommodation section; and a second engagement section disposed in the manipulation section and configured to engage with the first engagement section, the manipulation section has a base end portion connected with the second sheet accommodation section and a lever portion continuous from the base end portion, the lever portion is shiftable from a lying down posture to a tilted posture when so manipulated, the second engagement section is disposed in the lever portion, shift of the lever portion from the lying down posture to the tilted posture releases engagement between the first engagement section and the second engagement section, and allows the lever portion to be pulled in the first direction to slide the second sheet accommodation section and extend a size of the cassette, the first engagement section is a first protrusion protruding from a bottom of the first sheet accommodation section, the second engagement section is a second protrusion protruding from a forward end of the lever portion toward the first protrusion, the forward end of the lever portion is a forward end in a second direction opposite to the first direction in the lever portion, the first protrusion has a first engagement surface and a first inclined surface, the second protrusion has a second engagement surface and a second inclined surface, the first engagement surface and the second engagement surface are configured to engage with one another, the first inclined surface is inclined upward in the second direction, and the second inclined surface is inclined downward in the first direction.

17. The cassette according to claim 16, wherein the first engagement section is an engagement hole portion in a bottom of the first sheet accommodation section, the second engagement section is an engagement protrusion protruding from a forward end of the lever portion toward the engagement hole portion, the forward end of the lever portion is a forward end in a second direction opposite to the first direction in the lever portion, and the engagement protrusion is configured to mate with the engagement hole portion.

18. The cassette according to claim 16, wherein the base end portion of the manipulation section is connected with a bottom of the second sheet accommodation section, and the lever portion of the manipulation section is disposed at a location in the bottom, the location being lower than a surface on which the sheets are loaded.

19. The cassette according to claim 18, wherein the base end portion of the manipulation section is inclined downward in the first direction from the bottom of the second sheet accommodation section.

20. A feeder comprising:

the cassette according to claim 16; and a feeding section configured to feed a sheet from the sheets in the cassette.

* * * * *